US011891790B2

(12) United States Patent
Hansort

(10) Patent No.: US 11,891,790 B2
(45) Date of Patent: Feb. 6, 2024

(54) BOLTED SLANT ANCHOR DEVICE AND METHOD

(71) Applicant: CCS Contractor Equipment & Supply, LLC, Naperville, IL (US)

(72) Inventor: Marinus Hansort, St. Pete Beach, FL (US)

(73) Assignee: CCS Contractor Equipment & Supply, LLC, Naperville, IL (US)

( * ) Notice: Subject to any disclaimer, the term of this patent is extended or adjusted under 35 U.S.C. 154(b) by 51 days.

(21) Appl. No.: 17/653,040

(22) Filed: Mar. 1, 2022

(65) Prior Publication Data

US 2022/0275628 A1 Sep. 1, 2022

Related U.S. Application Data

(60) Provisional application No. 63/154,842, filed on Mar. 1, 2021.

(51) Int. Cl.
*E04B 1/04* (2006.01)
*E04B 1/41* (2006.01)

(52) U.S. Cl.
CPC ..... *E04B 1/043* (2013.01); *E04B 1/4135* (2013.01)

(58) Field of Classification Search
CPC ..... E04B 1/043; E04B 1/4135
See application file for complete search history.

(56) References Cited

U.S. PATENT DOCUMENTS

| | | | | |
|---|---|---|---|---|
| 5,609,005 | A * | 3/1997 | Schierloh | E04B 1/355 52/250 |
| 7,743,580 | B2 * | 6/2010 | DeLoach, Sr. | E04B 1/41 52/701 |
| 10,221,558 | B1 * | 3/2019 | Silva | E04B 1/043 |
| 2011/0239581 | A1 * | 10/2011 | Linares, III | E04B 1/043 52/699 |
| 2013/0031857 | A1 * | 2/2013 | Tincher | E04B 1/043 52/274 |

* cited by examiner

*Primary Examiner* — Patrick J Maestri
(74) *Attorney, Agent, or Firm* — Bodman PLC

(57) ABSTRACT

The present invention provides a foundation connection device disposed within a concrete structure, securing the concrete structure to a foundation when a bolt engages the foundation connection device and is driven into the foundation. The device includes a tubular post defining a cavity. A base plate has upper and lower surfaces, an aperture through the surfaces, and the lower surface aligns with a bottom surface of the concrete structure. A stop plate defining a circular through-hole is within the tubular post and receives the bolt. The bolt has a bolt head and a bolt shaft, and when the bolt engages the foundation connection device and is driven into the foundation, the bolt head engages the stop plate and the bolt shaft extends through the circular through-hole of the stop plate within the cavity of the tubular post, and through the aperture of the base plate into the foundation.

18 Claims, 11 Drawing Sheets

BOLTED SLANT ANCHOR DEVICE AND METHOD

CROSS-REFERENCE TO RELATED APPLICATION

The present application claims the filing benefit of U.S. Provisional Application, Ser. No. 63/154,842, filed Mar. 1, 2021, which is hereby incorporated herein by reference in its entirety.

TECHNICAL FIELD

The present disclosure relates generally to concrete wall panel construction, and more particularly to an anchor or bracket device for connecting a concrete wall to a floor or footing.

BACKGROUND

Precast concrete wall panel construction or tilt-up construction is a common construction method used to construct buildings, such as commercial buildings (e.g., office buildings, warehouses, factories, and the like). In general, concrete forms are constructed in several sizes and shapes (most commonly various shaped panels and columns) dictated by the specifications of what will become the finished structure. The forms are filled with liquid concrete which is then allowed to cure. The cured concrete structures are then erected and secured at a foundation to form the skeleton of a structure.

Often, the concrete structures are secured at the foundation via respective components of the structure and foundation that must be aligned or fitted together when the structure is erected, such as base plates at the bottom surface of the structure and embedded anchors at the upper surface of the foundation. However, such embedded two-piece securing means must be precisely located during formation of the structures and foundation to ensure proper alignment and the bolts and base plates can easily be damaged during construction. Thus, such embedded two-piece securing means can be unreliable during the construction process. A misaligned or damaged securing element can cause delays and increase construction costs.

It is generally known to use a component that is pre-placed in only the precast concrete structure and therefore does not need to be aligned with a matching component in the foundation. However, such known components typically require drilling into the foundation below the concrete structure via a passageway of the pre-placed component and then inserting a metal rod, such as rebar, into the drilled hole. The hole and passageway are then filled with wet concrete that must cure for the rod to secure the structure to the foundation, which at times can be undesirable.

Securing the concrete panels to the foundation is critical to provide resistance to lateral or uplift forces on the erected structures relative to the foundation caused, for example, by strong winds, earthquakes, or other forces. Therefore, a need exists for connection means to secure precast concrete structures to a foundation in a manner that advances the art.

SUMMARY

The present disclosure provides a foundation connection device or a slant anchor and method for use of such device in the forming, placing, and securing of a concrete structure at a foundation, such as a floor or footing.

According to one aspect of the present disclosure, a foundation connection device is configured to be embedded within a concrete structure at a bottom surface of the concrete structure for securing the concrete structure to a foundation when a bolt engages the foundation connection device and is driven into the foundation. The foundation connection device includes a base plate that has an upper surface, a lower surface opposite the upper surface, and an aperture through the upper and lower surfaces. The lower surface is configured to substantially align with the bottom surface of the concrete structure. A tubular post includes a lower end that is connected to the base plate and defines an opening at the lower end that surrounds the aperture of the base plate. A central axis of the tubular post is oriented at a non-right angle relative to the base plate. An anchoring member includes a lower portion that is coupled to at least one of the base plate and the tubular post. An upper portion of the anchor member has engagement features that are configured to form an embedded connection in the concrete structure. A stop member is fixed within an interior the tubular post and includes a through-hole and a peripheral upper surface surrounding the through-hole. When the bolt engages the foundation connection device and is driven into the foundation, a shaft of the bolt extends through the through-hole of the stop member and the aperture of the base plate into the foundation and a head of the bolt engages the peripheral upper surface of the stop member.

Implementations of the disclosure may include one or more of the following optional features. In some implementations, the second end of the tubular post has a flange surface planar to the second opening and the flanged opening may lie on a plane perpendicular to the base plate. In some implementations the body of the tubular post is a cylindrical pipe and in those implementations, the second end of the tubular post defines an oval shape.

In some examples, the bolt may include of the tubular post has a flange surface planar to the second opening and the flanged opening may lie on a plane perpendicular to the base plate. In some implementations the body of the tubular post is a cylindrical pipe and in those implementations, the second end of the tubular post defines an oval shape.

In some implementations the anchor member includes an anchor rod that is attached at an exterior surface of the tubular post. In those implementations, the anchor rod has a lower length tangential and attached to the exterior surface of the tubular post and an upper length extending away from the tubular post and angled relative to the lower length so as to be perpendicular to the base plate.

According to another aspect of the present disclosure, a method is provided for securing a concrete structure to a foundation with a foundation connection device within the concrete structure. The method includes the step of providing a foundation connection device having a base plate with an aperture through the base plate and a tubular post defining a cavity. The tubular post is disposed at an upper surface of the base plate surrounding the aperture at a first end and extends at a non-right angle relative to the base plate. The method further includes the step of positioning and retaining a lower surface of the base plate of the foundation connection device at an interior wall of a concrete form so that the lower surface of the base plate will be aligned with a lower surface of the concrete structure made using the concrete form. The next step is pouring liquid concrete into the concrete form such that a second end of the tubular post is exposed at an exterior surface of the poured liquid concrete. The method also includes curing the liquid concrete to form the concrete structure and removing the concrete form from the formed concrete structure. The method further includes the step of erecting the formed concrete structure at the foundation such that the lower surface of the base plate and the lower surface of the concrete structure engage an upper surface of the foundation. Next, drilling along a central axis of the tubular post into the upper surface of the foundation to form a hole in the foundation. The method includes driving a bolt through a stop plate within the cavity of the tubular post and into the hole in the foundation until a bolt head of the bolt engages a surface of the stop plate so that the bolt engages the foundation. The method includes covering an exposed flanged opening at the second end of the tubular post with patching grout to provide a smooth outer surface of the concrete structure.

This aspect may include one or more of the following optional features. Before pouring liquid concrete into the concrete form, a foam plug may be positioned at the second end of the tubular post to prevent liquid concrete from entering the flanged opening. The foundation connection device may further have an anchor rod extending from an exterior surface of the tubular post.

Therefore, a slant anchor and method for use according to the present disclosure provides an improved securing means for a concrete structure to a foundation where a hole is drilled through the slant anchor into the foundation and a bolt is driven into the drilled hole to engage a stop plate of the slant anchor and engage the foundation beneath the slant anchor. A slant anchor with a bolt connection provides reliability as the receiving hole for the bolt is drilled into the foundation after the concrete structure is erected. Consistency is achieved in the depth and angle of the bolt driven into the concrete due to the stop plate within the post and the bolt engaging the stop plate and engaging the foundation ensures a durable connection between the bolt and foundation. The flanged surface providing a receiving surface for patching grout also ensures that after the bolt is driven into the foundation through the slant anchor, the slant anchor may be sealed into the concrete structure, hidden from sight with limited mess at the outer surface of the structure.

The details of one or more implementations of the disclosure are set forth in the accompanying drawings and the description below. Other aspects, advantages, purposes, and features will be apparent upon review of the following specification in conjunction with the drawings.

BRIEF DESCRIPTION OF THE DRAWINGS

Like reference symbols in the various drawings indicate like elements.

DETAILED DESCRIPTION

Figure 1:
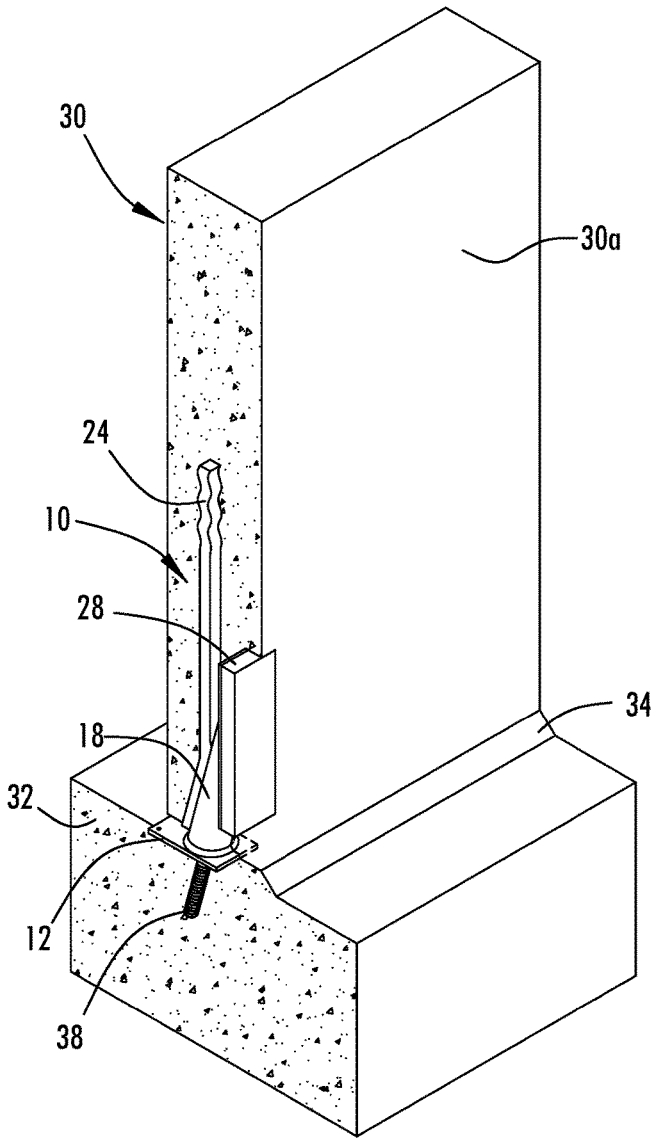
FIG. 1 is a perspective view of a slant anchor disposed in a precast concrete wall panel and positioned at a concrete footing of a foundation, with a foam plug positioned at the flanged opening of the tubular post.
Figure 2:
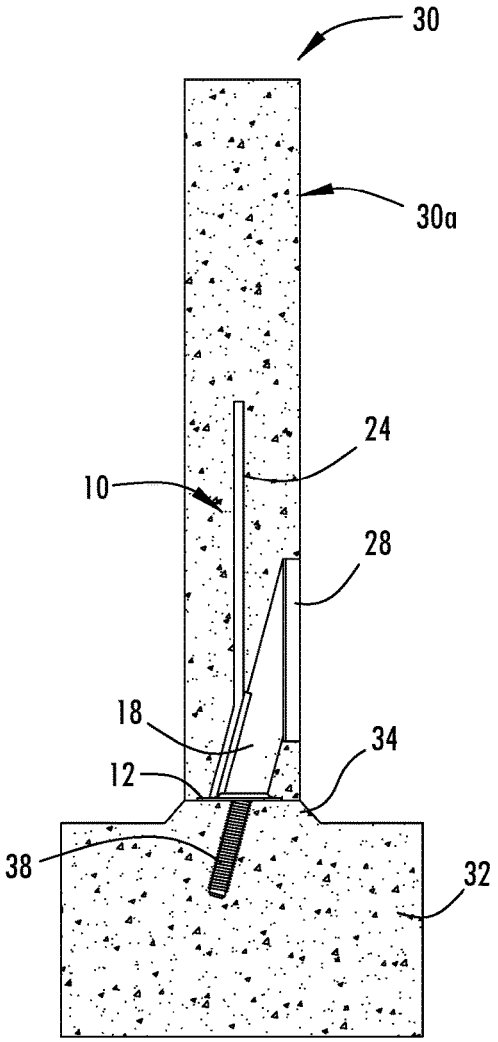
FIG. 2 is a side elevation view of the slant anchor, concrete wall panel, foundation, and foam plug of FIG. 1.

Referring now to the drawings and the illustrative examples depicted therein, a foundation connection device (referred to herein as a "slant anchor") is embedded in a precast concrete structure (such as a tilt-up or precast wall panel or column) at the base of such structure for securing the precast concrete structure to a foundation and for providing rigid support to the structure's connection at the foundation. As shown in FIGS. 1 and 2, the slant anchor 10 is cast in the base of a concrete wall panel 30 for placement at the concrete footing 34 of a foundation 32. A bolt 38 passes through an opening 14 in the base plate 12 and a tubular post 18 of the slant anchor 10 to threadably engage the footing 34 and foundation 32. A foam plug 28 engages and covers a flanged opening 20 of the tubular post 18. An anchor rod 24 of the slant anchor 10 extends upwards from the tubular post 18 of the slant anchor 10 into the height of the concrete wall panel 30. A bottom surface **12*b* of a baseplate 12 of the slant anchor 10 is exposed at a bottom surface 30*b* of the wall panel 30 such that an opening 14 through the base plate 12 is exposed to the concrete footing 34** below.

As will become clear through the disclosure below, use of a slant anchor to secure a concrete structure to a foundation provides increased reliability, durability, and consistency over methods known in the art. Drilling a hole into the foundation guided by the angle of the tubular post and stop plate disposed within the post ensures a consistent engagement angle among multiple structures erected and secured via a bolt engaging a slant anchor. The bolt engaging the stop plate and engaging the foundation ensures a consistent engagement depth. The flanged opening of the tubular post provides a receiving surface for patching grout to seal the slant anchor into the wall, hidden from sight. Overall, a method of securing a concrete structure to a foundation via a bolt engaging the foundation and the slant anchor provides a more reliable, durable, consistent, and discrete connection.

Figure 3:
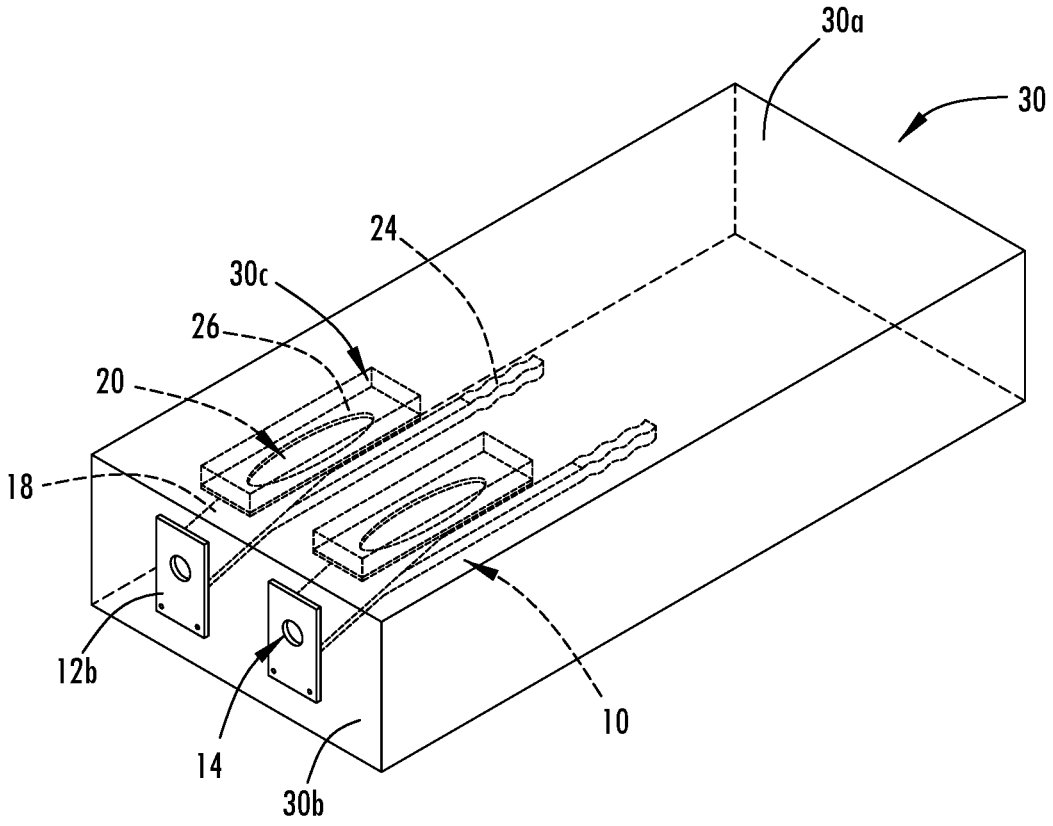
FIG. 3 is a perspective view of two slant anchors disposed in a precast concrete wall.

To dispose the slant anchor 10 in a cured concrete structure, a concrete form is first built. The slant anchor 10 is positioned at an interior surface of the form so that the bottom surface 12*b* of the base plate 12 will align with the bottom surface 30*b* of a cured concrete structure 30 (such as seen in FIG. 3). The slant anchor 10 is retained at the form, such as via nails through holes 16 in the base plate 12. Liquid concrete is then poured into the form around and covering the slant anchor 10 up to a flanged surface 26 at the flanged opening 20 of the tubular post 18. A foam plug 28 is placed at the flanged surface 26 to prevent liquid concrete from covering the flanged surface 26 or entering the post 18 through the flanged opening 20. The liquid concrete may then be poured above the level of the flanged surface 26, creating a recess 30*c* in the vertical wall 30*a* of the panel 30 that is exposed when the foam plug 28 is removed. The slant anchor 10 is secured in place within the wall panel 30 by the hardening of the concrete and the form is removed leaving only a cured concrete wall panel 30 with a slant anchor 10 disposed within.

In reference to FIG. 3, two slant anchors 10 are shown disposed in a precast concrete wall panel 30. A bottom surface 12*b* of the base plate 12 is exposed at the bottom surface 30*b* of the wall panel 30 so that when the wall panel is positioned at a foundation 32 (such as in FIGS. 1 and 2), the opening 14 through the base plate 12 is exposed to the foundation 32 or concrete footing 34 at the bottom surface 12*b* of the base plate. The base plate 12 may be secured at the form (such as via nails, screws, bolts, or the like driven through the form and holes 16 at the base plate) to prevent movement of the slant anchor 10 during the curing process and ensure the base plate (and therefore opening through the base plate) will remain exposed at the bottom surface 30*b* of the cured wall panel 30. The base plate 12 is positioned so that the bottom surface 12*b* is substantially flush with the bottom surface 30*b* of the wall panel 30 so that when the wall panel is erected and positioned at the foundation 32, the base plate and bottom surface of the wall panel sit flush and level at the foundation.

A cylindrical or tubular post 18 is welded to or integrally formed with a top surface 12*a* of the base plate 12 and extends at a non-right angle from the base plate, with an interior surface of the tubular post 18 defining a cavity therethrough. Extending the length of the tubular post 18, the cavity (and therefore bottom opening 22 of the tubular post) aligns with the opening 14 through the base plate. The opening 14 through the base plate 12 may have a smaller diameter than the cylindrical cavity of the tubular post 18. This helps to improve the accuracy or matching of the angle of the hole 36 drilled into the foundation 32 through the base plate (and therefore the angle of the bolt 38 driven into the drilled hole 36) to the angle of the tubular post 18.

At the end of the tubular post 18 distal the end integrally formed with the base plate is a flanged opening 20 with a flange surface 26 surrounding the opening of the tubular post 18. The tubular post is angled relative to the base plate such that the opening 20 and flange surface 26 are exposed at a vertical surface 30*a* of the wall panel 30 perpendicular to the bottom surface 30*b* at which the base plate 12 is exposed. The flange surface 26 is parallel to the vertical surface 30*a* of the wall and, like the bottom surface of the base plate, is exposed at the surface of the wall panel following the curing process. However, and as discussed above, the flange surface 26 may be present within a recess 30*c* of the wall panel 30 due to the placement of the foam plug at the flange surface during the forming process of the wall panel. The flanged opening 20 of the tubular post 18 lies on a plane perpendicular to the base plate 12. Due to the angle and cylindrical form of the tubular post 18 and the vertical nature of the flanged opening 20, the flanged opening has an elongated oval shape. As will become clear, this elongated oval shape provides the advantage of a wide opening to the cavity of the tubular post and therefore increased visibility and access for tools and the bolt that will be disposed in the tubular post when the wall panel is erected at the foundation. The opening through the flange matches the elongated oval shape of the tubular post.

The flange surface 26 is recessed from the vertical surface 30*a* of the wall 30 so that the slant anchor 10 may more easily be grouted in to the wall 30 (patched over with patching grout 42 following the final step of securing the wall panel 30 to the foundation 32) to seal the cavity of the tubular post 18 and hide the slant anchor 10 from view after the wall 30 is secured. Thus, during the curing process of the concrete, a foam plug 28 is placed at the flange surface 26 to prevent liquid concrete from entering the tubular post 18 through the flanged opening 20. The flange surface provides a flat surface for the foam plug 28 to be placed, adhered, or otherwise disposed over the opening 20 and also provides a surface to which the patching grout 42 may be placed once the wall panel is secured at the foundation.

The foam plug 28, which is preferably made of STYROFOAM™ material but may comprise any suitable material, has substantially the same dimensions as the flange surface 26 and a thickness suitable to prevent liquid concrete from covering the flange surface 26 or entering the flanged opening 20 and therefore cover the flange or fill the tubular post during the curing process. The foam plug 28 may be adhered to the flange surface 26 such as via an adhesive backing to prevent movement of the plug from during the pouring and curing process. When the curing process is complete and the wall panel 30 is formed, the foam plug 28 is removed from the flange surface (before or after the wall panel is erected and positioned at the foundation) to provide access to the cavity of the tubular post through the flanged opening 20.

Figure 4:
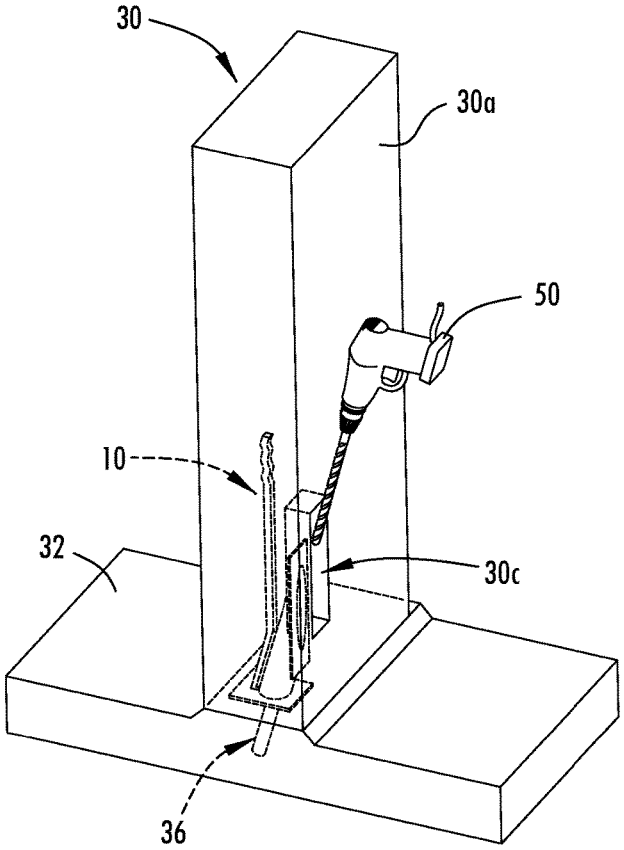
FIG. 4 is a perspective view of a slant anchor disposed in a precast concrete wall panel positioned at a concrete footing of a foundation and showing a drill being used to drill a hole, guided by the tubular post of the slant anchor, through the concrete footing and foundation.
Figure 5:
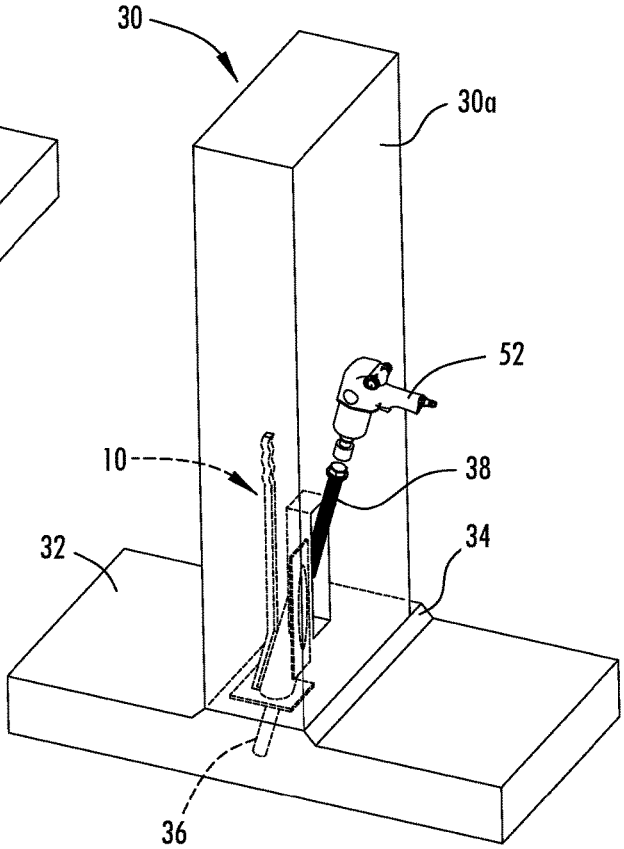
FIG. 5 is a perspective view of the slant anchor, concrete wall panel, and foundation of FIG. 4 and showing, after the hole is drilled through the concrete footing and foundation, a pneumatic drill being used to drive a bolt, guided by the tubular post and an internal stop plate, into the concrete footing and foundation.

In reference to FIGS. 4 and 5, when the wall panel 30 is erected and positioned at the foundation 32, such as at a concrete footing 34 of the foundation 32, the foam plug is removed (or has already been removed) from the flanged opening 20 to expose the elongated oval flanged opening and cavity through the tubular post 18. A drill 50 is used to drill a hole 36, at an angle guided by the angle of the tubular post 18 relative to the base plate 12, into the footing 34 and foundation 32 beneath the bottom surface 30*b* of the wall panel 30. The drill bit is placed through the flanged opening, through the cavity of the tubular post through the stop plate within the cavity of the post, and through the opening in the base plate to contact the foundation 32 and drill the hole 36 therethrough. Because the hole 36 is drilled with the tubular post as a guide, the drilled hole 36 substantially aligns with and is on the same central axis as the cavity of the tubular post 18. A bolt 38 is then driven into the drilled hole 36 and thus into the foundation 32 beneath the bottom surface of the wall panel 30 (FIG. 5) to secure the wall panel thereat such as via use of a pneumatic drill 52 or other suitable tool. Additionally, liquid concrete or epoxy or any suitable curing product may be injected or otherwise inserted into the drilled hole 36 prior to driving the bolt 38 into the hole (FIG. 6) to provide increased retention of the bolt at the foundation. The bolt may be a structural expansion or self-tapping or wedge or any other suitable bolt for engaging the concrete foundation.

Figure 6:
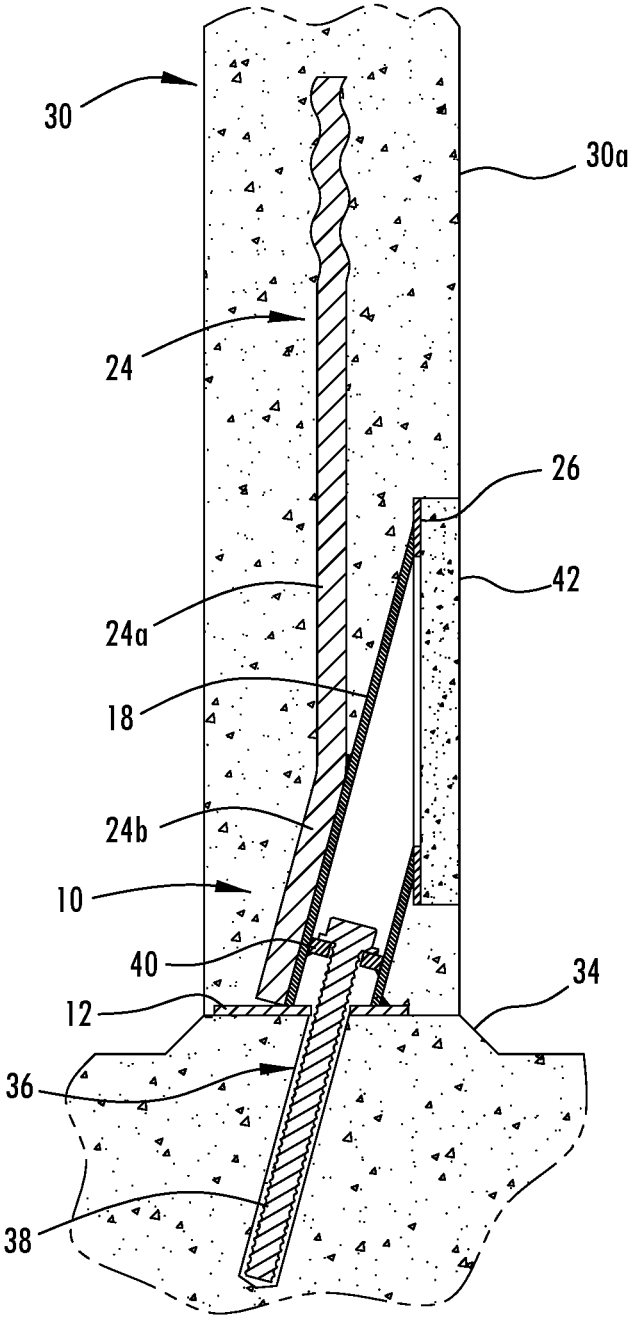
FIG. 6 is a cross-sectional view of a slant anchor disposed in a precast concrete wall positioned at a concrete footing of a foundation with a bolt driven through the concrete footing and foundation and securing the slant anchor and wall panel thereat, with patching grout disposed at the flange surface, encasing the slant anchor in the wall.

As shown in FIG. 6, the bolt 38 is driven into the foundation 32 beneath the wall panel 30 until the bolt head 38*a* contacts and is resisted by a stop member or plate 40 disposed within the tubular post 18. The stop plate 40 has a through-hole, such as to resemble a washer or similar disc shape plate. The stop plate 40 is fixed into place, such as via welding, or otherwise disposed within the cavity of the tubular post 18 so that as the bolt 38 is driven through the cavity of the tubular post, through a hole 40*a* in the stop plate 40, and through the opening 14 in the base plate 12 into the foundation 32, the bolt head 38*a* engages the surface of the stop plate 40 and thus retains the slant anchor 10, and therefore wall panel 30, at the foundation 32. The stop plate 40 is a planar disc with a thickness about double the thickness of the wall of the tubular post and positioned within the tubular post 18 perpendicular to the longitudinal axis of the tubular post so as to provide a substantially perpendicular or flat seat to the bolt head 38*a* as the bolt is driven into the foundation at an angle according to the angle of the tubular post. Additionally, the stop plate 40 is positioned relatively deep within or near the bottom of the tubular post 18 to allow a significant length 38*b* of the bolt 38, such as a threaded shank portion of the bolt, to extend below the slant anchor into the foundation 32 below. As can be seen in FIG. 6, if an epoxy is disposed within the drilled hole 36 before the bolt 38 is driven into the hole, excess epoxy material may fill the cavity of the tubular post 18 below the stop plate 40 and above the base plate 12 to further retain the bolt 38 within the foundation 32 and slant anchor 10 and further adhere the slant anchor and therefore wall panel to the foundation.

Furthermore, because the stop plate 40 is positioned perpendicular to the walls of the tubular post 18, passage of the bolt 38 through the stop plate as it is driven into the foundation 32 beneath the wall panel 30 helps to ensure that the angle of the bolt is substantially similar to the angle of the tubular post. Therefore a more consistent and safe connection between the wall panel 30 and the foundation 32 may be established. Because the bolt 38 is responsible for transferring lateral forces experienced at the connection between the wall panel and the foundation upwards through the slant anchor 10 and (as will be discussed in further detail below) one or more anchor rods 24 or plates of the slant anchor to the concrete wall, consistent placement of bolts at a desired angle across multiple panels is critical in being able to calculate the structural limits of a given structure and ensure structural integrity. Optionally, the bolt 38 may threadably engage the stop plate so as to provide a more snug connection between the bolt and the stop plate or the bolt may simply pass through an unthreaded opening in the stop plate to engage the foundation beneath the wall panel. A threaded connection between the bolt and stop plate may also align the angle of the bolt to the tubular post as the bolt is driven into the foundation.

Use of a bolt in retaining the slant anchor to the foundation is critical to securing the wall panel at the foundation. The bolt 38 engages the foundation 32 (and optionally threadably engages the stop plate or hole in the base plate of the slant anchor) to retain the bolt. The entire length 38*b* of the bolt 38 may be threaded for threadably engaging the foundation or, such as in the case of a self-tapping concrete bolt, the length 38*b* of the bolt may have both a threaded portion threadably engaging the foundation and an unthreaded portion engaging the foundation. Therefore, when forces act upon the bolt 38 as a retaining element of the slant anchor 10 (such as vibrations during construction, epoxy or concrete poured into the cavity of the tubular post, or environmental conditions acting on the wall panel), the bolt 38 will remain in position within the foundation 32. In other words, the bolt is less likely to shift or pull out of the foundation than a non-threaded retaining element and therefore improves the structural integrity of a wall panel with a slant anchor according to the present disclosure.

After the bolt 38 is driven through the foundation 32 beneath the bottom surface 30*b* of the wall panel 30 and bottom surface 12*b* of the base plate 12 to secure the slant anchor 10 and wall 30 at the foundation 32, patching grout 42 may be placed at the flange surface 26 to cover the flanged opening 20 and therefore seal the opening and visibly hide the slant anchor 10 from view within the wall panel. Material, such as concrete or epoxy, may also be poured into the cavity of the tubular post 18 after driving the bolt into the foundation and before applying the patching grout if desired. Thus, the slant anchor and bolt becomes completely covered and is fully inside the wall with no exposed portion at or beyond the outer surfaces of the wall panel.

An anchoring member or anchor rod 24 extends from the tubular post vertically into the height of the wall panel 30 and is aligned with the bolt 38 driven into the foundation so that lateral or upward forces experienced by the slant anchor, such as due to strong winds or earthquakes, are transferred to the concrete wall. The anchor rod also provides increased attachment surface area between the slant anchor 10 and the concrete structure. The anchor rod 24 has a lower portion 24*b* and an upper portion 24*a*. The lower portion 24*b* is welded to or integrally formed with an outer surface of the tubular post 18. The lower portion 24*b* of the anchor rod is angled relative to the base plate 12 at the same angle as the tubular post 18 and is positioned at an upward-facing surface of the tubular post 18 so that the upper portion 24*a* (angled relative to the lower portion so as to be perpendicular to the base plate) extends vertically from the tubular post 18 into the height of a concrete structure at which a slant anchor is disposed with the base plate at a bottom surface of the structure. For example and as seen in FIGS. 1-6, the upper portion 24*a* anchor rod 24 extends from the tubular post 18 parallel to the vertical surfaces 30*a* of the wall panel 30. An upper end of the upper portion 24*a* of the anchor rod 24 is sinuously shaped to provide an engagement feature.

Figure 7:
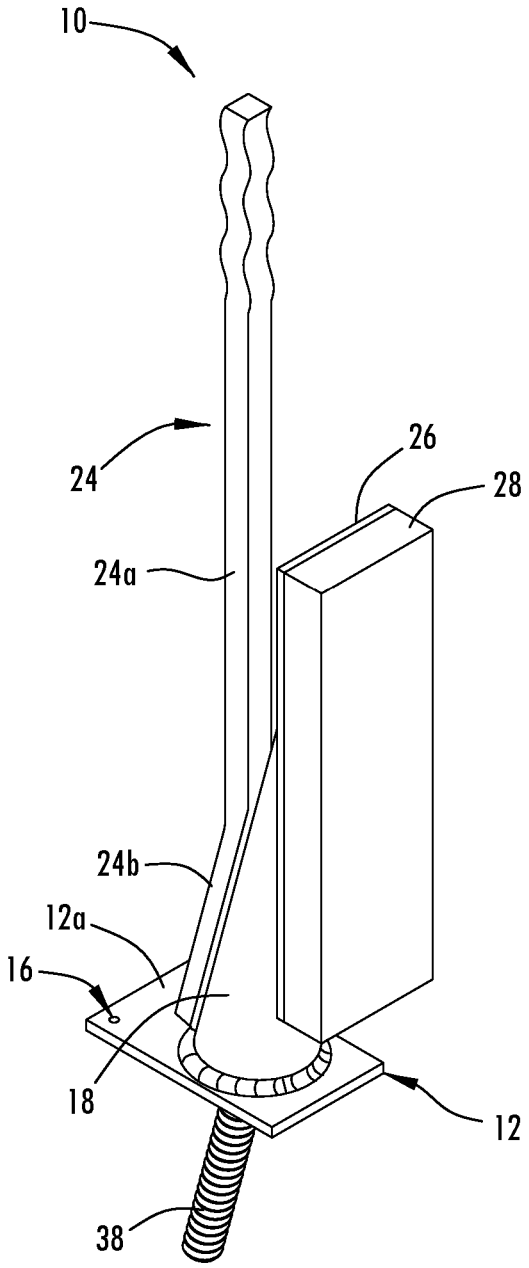
FIG. 7 is a perspective view of a slant anchor with a bolt disposed within the tubular post and a foam plug disposed at and covering the flanged opening.
Figure 15:
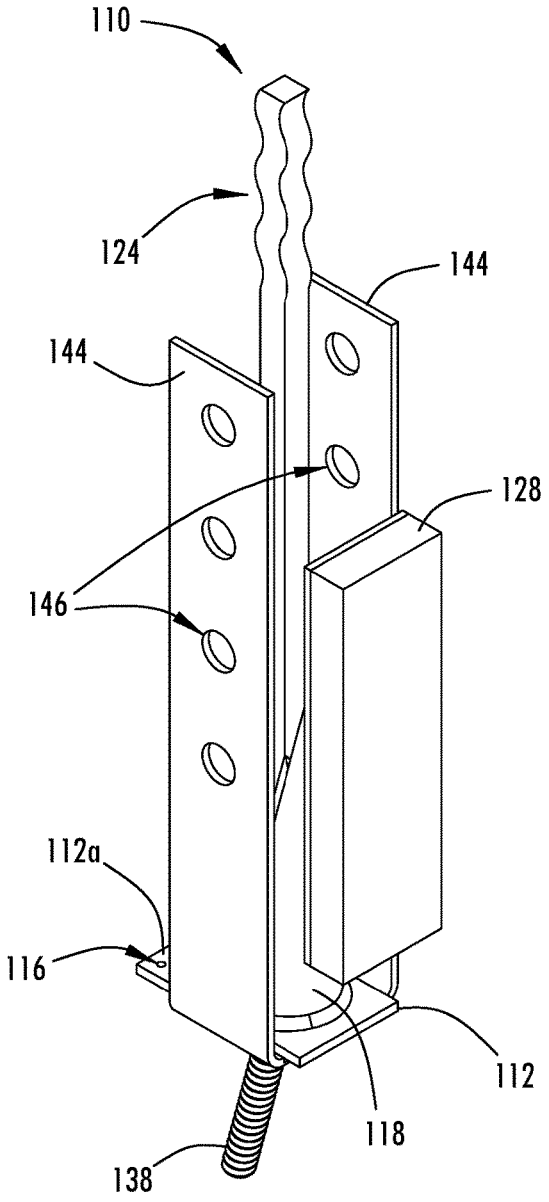
FIGS. 15 and 16 are perspective views of a slant anchor with anchor plates, a bolt disposed in the tubular post, and a foam plug disposed at and covering the flanged opening.
Figure 16:
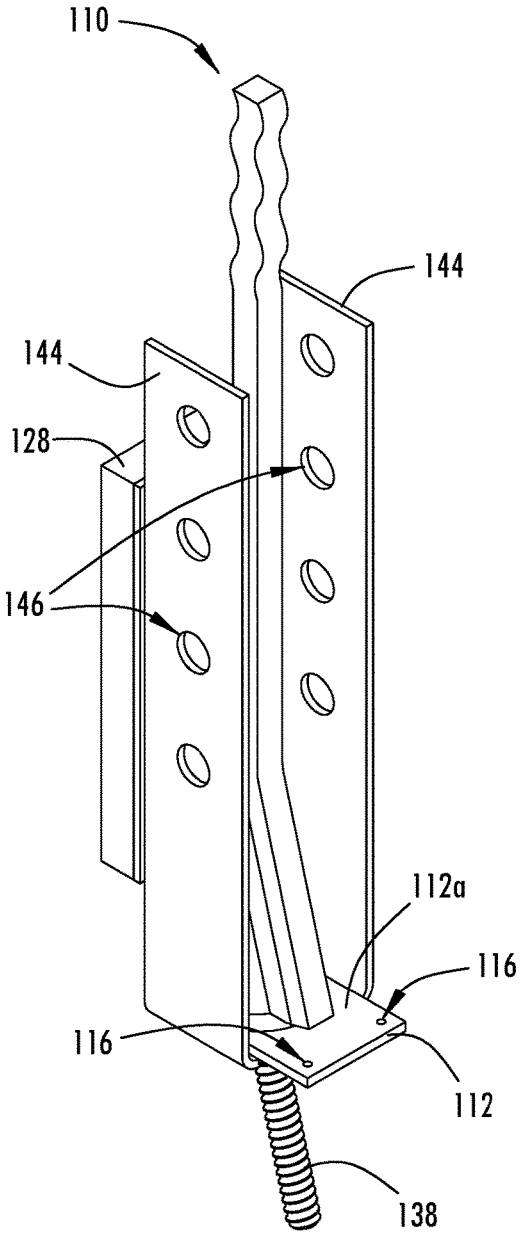
Figure 17:
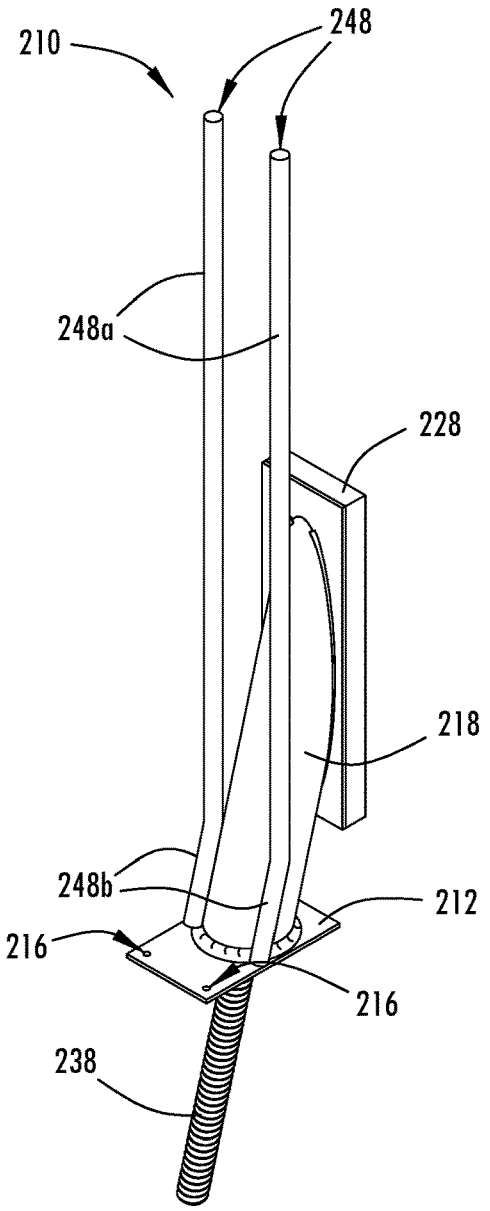
FIG. 17 is a perspective view of a slant anchor with two anchoring members, a bolt disposed in the tubular post, and a foam plug disposed at and covering the flanged opening.

In additional implementations, the slant anchor may have more than one anchoring member, such as anchor rods or anchor plates, at the sides or rear of the tubular post 18 and/or base plate 12 to provide further support and further dissipate any load felt by the slant anchor within the concrete wall. For example, and as shown in FIGS. 15 and 16, an additional example of a slant anchor 110 includes anchor plates 144 that extend from opposite sides of the base plate 112 vertically into the height of the wall and parallel to the anchor rod 124. The anchor plates 144 may have through holes 146 disposed therein to aid in the passage of liquid concrete through and around the anchor plates 144 during the forming and curing process of the concrete structure and to provide an engagement feature. The anchor plates 144 may be welded to or integrally formed with the base plate 112. The one or more anchor rods and/or plates may comprise any suitable shape or configuration for providing vertical support within the height of the concrete structure and increased attachment, via surface area and/or an engagement feature of the anchoring member, between the connection device and the concrete structure. For example, the one or more anchoring member may comprise any suitable size, or shape for increasing the engagement between the slant anchor and the concrete structure, such as an anchor rod having a square cross-sectional shape (such as in FIG. 7), plain bar having a round cross-sectional shape, any suitable form of deformed bar or anchor plates. Additionally, the one or more anchoring member may have any suitable form of engagement feature, such as a sinuously shaped portion of an anchor rod, surface texture of deformed bar, or through holes in an anchor plate.

Figure 18:
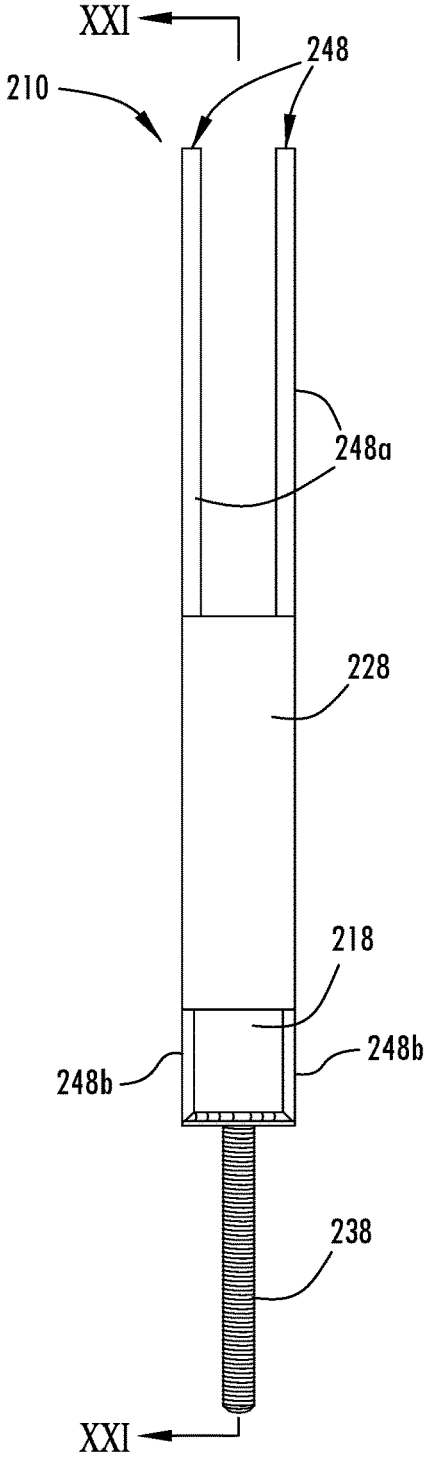
FIG. 18 is a front plan view of the slant anchor, bolt, and foam plug of FIG. 17.
Figure 19:
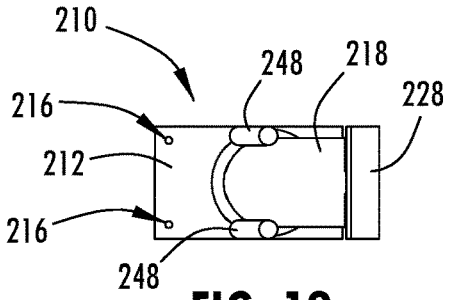
FIG. 19 is a top plan view of the slant anchor and foam plug of FIG. 17.
Figure 20:
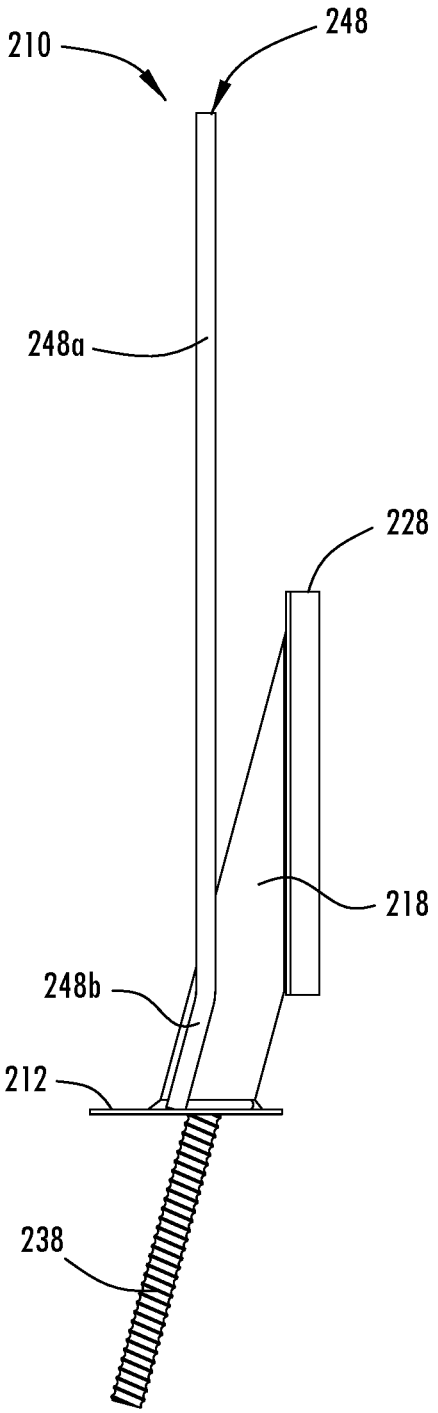
FIG. 20 is a side plan view of the slant anchor, bolt, and foam plug of FIG. 17.
Figure 21:
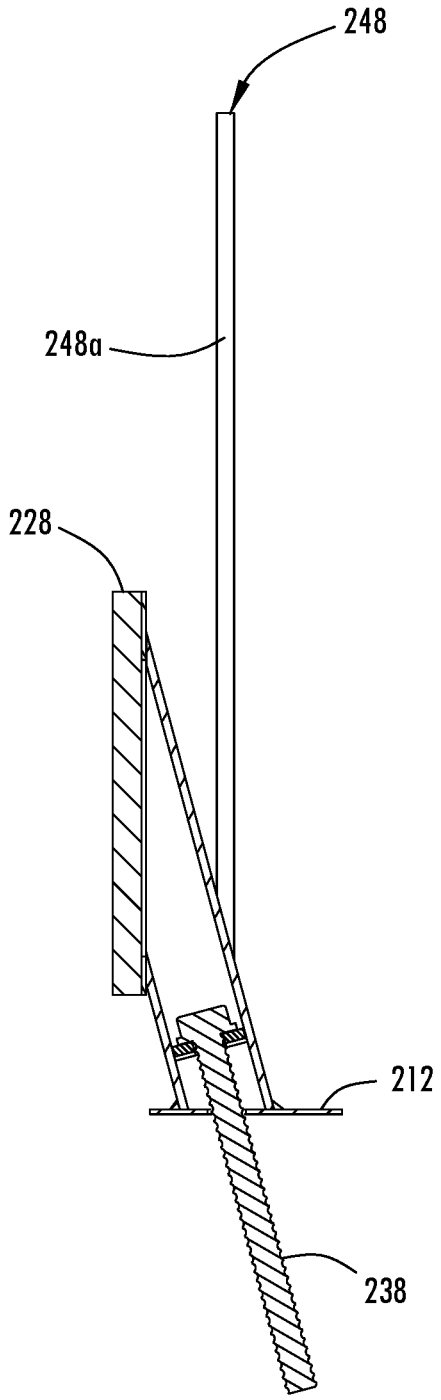
FIG. 21 is a cross-sectional view of the slant anchor, bolt, and foam plug of FIG. 17.

As shown in FIGS. 17-21, another example of a slant anchor 210 has a further implementation of an anchoring member. The slant anchor 210 is shown with two plain anchor rods 248 attached to the outer surface of the tubular post 218. The plain anchor rods 248 are similar to anchor rods 24 shown in FIGS. 6-11 in that they have lower portions 248*b* attached at the outer surface of the tubular post 218 and upper portions 248*a* extending upwards to engage the concrete structure. The lower portions 248*b* are welded to or integrally formed with the outer surface of the tubular post 218. The lower portion 248*b* of the plain anchor rod 248 is also angled relative to the base plate 212 at the same angle as the tubular post 218 so that the upper portions 248*a* (angled relative to the lower portion so as to be perpendicular to the base plate) extend vertically from the tubular post 218 into the height of the concrete structure. The plain anchor rods 248 are positioned (such as seen in FIGS. 18 and 19) at outboard positions on the outer surface of the tubular post so that the rods are substantially aligned with the outer edges of the base plate 212. Similar to the anchor rod 24 shown in FIGS. 6-11, the plain anchor rods 248 are also positioned so that the vertical upper portion 248*a* substantially aligns with the positioning of the bolt 238 disposed within the slant anchor 210 and into the foundation below.

Figure 8:
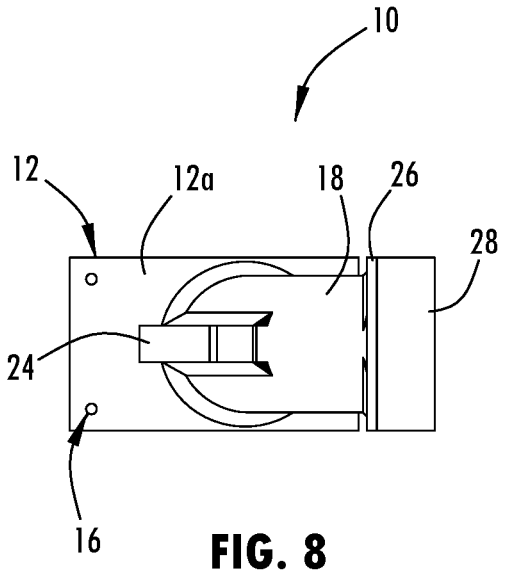
FIG. 8 is a top plan view of the slant anchor and foam plug of FIG. 7.

As shown in FIGS. 8-14 and 18-21, the slant anchor assemblies and individual components, such as the foam plug 28 and the bolt 38 used to secure the slant anchor to the foundation may all have preferred dimensions for manufacture. However, it should be understood that the slant anchor assembly and associated components, devices, uses, and optional portions may be altered as necessary for a given application without straying from the spirit of the present disclosure. For example, FIG. 8 shows that the base plate 12 has a width of approximately 3 inches and a length of approximately 5 inches, but it should be understood that the base plate may be larger or smaller than the indicated dimensions based on such factors as the thickness of the concrete wall panel or column in which the slant anchor will be installed. A thick concrete panel will likely require a larger slant anchor assembly (with therefore a larger base plate) than, for example, a slim concrete column. It should also be understood that the base plate may be rounded, oval-shaped, or any two-dimensional, polygonal shape suitable for the given application.

Figure 9:
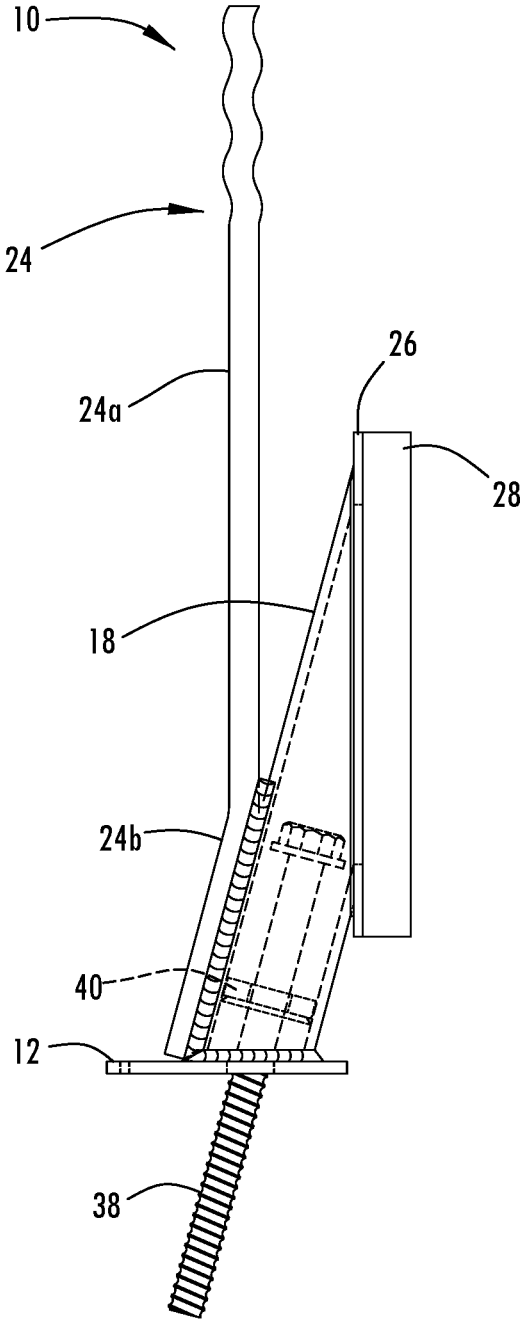
FIG. 9 is a side plan view of the slant anchor, bolt, and foam plug of FIG. 7.
Figure 11:
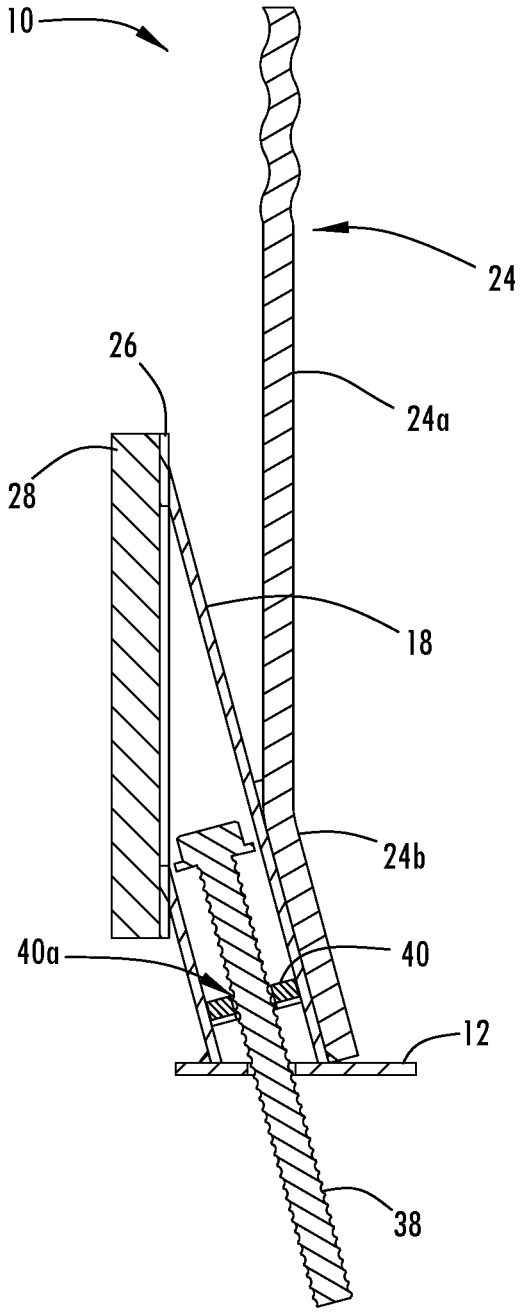
FIG. 11 is a cross-sectional view of the slant anchor, bolt, and foam plug of FIG. 7.

As shown in FIG. 9, the base plate 12 may have a thickness such as approximately 0.25 inches. As also shown in FIG. 9, the tubular post 18 (and therefore the bolt driven into the foundation at an angle guided by the tubular post and stop plate) may be angled relative to the base plate 12 at an angle of approximately 75 degrees. Thus, and as shown in FIG. 11, the lower portion 24*b* of the anchor rod 24 is also angled relative to the base plate 12 at an angle of approximately 75 degrees and a bend in the anchor rod 24 between the lower portion 24*b* and upper portion 24*a* of 15 degrees (FIG. 13) achieves the desired perpendicular relationship between the upper portion 24*a* of the anchor rod and the base plate 12.

Figure 10:
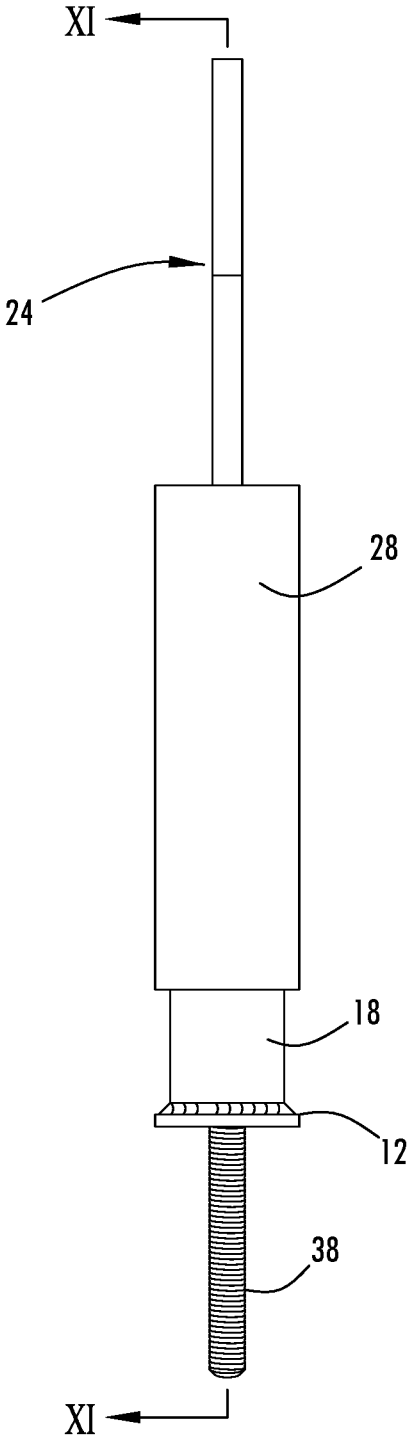
FIG. 10 is a front plan view of the slant anchor, bolt, and foam plug of FIG. 7.

As shown in FIG. 10, the foam plug 28, and therefore the perimeter of the underlying flange surface 26, has a length of approximately 10.5 inches and a width of approximately 3 inches. As shown in FIG. 11, the foam is approximately 1 inch thick and the flange is approximately 0.188 inches thick. The stop plate 40 within the tubular post 18 is approximately 0.375 inches thick. The anchor rod 24 has a total length of approximately 22 inches and a #5 diameter of approximately 0.625 inches. The anchor rod 24 may have any other suitable diameter or gauge measurement such as #2 (0.25 inches), #4 (0.5 inches), #6 (0.75 inches), or may comprise two anchor rods or rebar anchoring members such as two 2# (0.5 inches) pieces of rebar. The length of the lower portion 24*b* of the anchor rod, and therefore the length of the portion of the tubular post contacting the anchor rod, is approximately 5.196 inches. The tubular post 18 has an outer diameter of approximately 2.37 inches and an inner diameter of approximately 1.939 inches.

Figure 12:
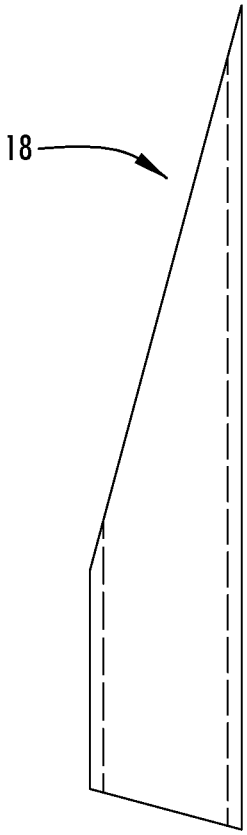
FIG. 12 is a side plan view of the tubular post of a slant anchor.
Figure 13:
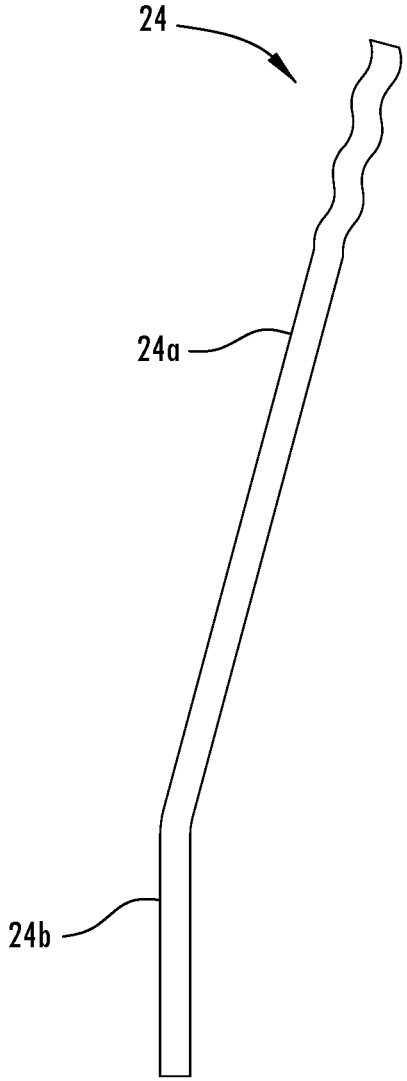
FIG. 13 is a side plan view of an anchor rod of a slant anchor.

As shown in FIG. 12, the tubular post 18 has a long or top end and a short or bottom end such that, when the tubular post is attached to the base plate 12, the flanged opening 20 is perpendicular to the base plate 12. Thus the short or bottom end is approximately 3.395 inches and the long or top end is approximately 12.875 inches in the illustrated embodiment.

Figure 14:
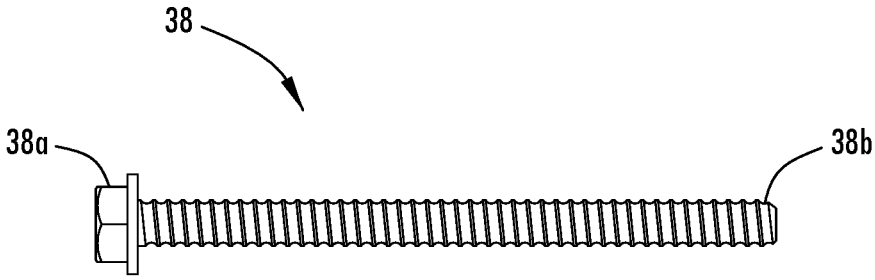
FIG. 14 is a side plan view of a bolt configured for use with a slant anchor.

As shown in FIG. 14, the bolt 38 has a threaded length 38*b* such as approximately 10 inches and a diameter such as approximately 0.75 inches.

Thus the present disclosure provides a foundation connection device or a slant anchor and method for use of such device in the forming, placement, and securing of a concrete structure at a foundation. The slant anchor provides a base plate with a bottom surface flush with the bottom surface of a cured concrete structure and with a post extending from a top surface of the base plate. The post extends from the top surface of the base plate at a non-right angle relative to the base plate and defines a cavity extending the length of the post. The cavity of the post aligns with a hole through the thickness of the base plate. The end of the post opposite the end integrally formed with the base plate defines a flanged opening. When the cured concrete structure is erected at a foundation, the flanged opening is exposed at a vertical surface of the concrete structure, the bottom surface of the base plate aligned with the bottom surface of the concrete structure is resting on an upper surface of the foundation with the hole of the base plate exposed to the foundation, and the post provides a cavity between the flanged opening and the hole in the base plate. A stop plate with a through-hole aligned with the central axis of the post is disposed within the cavity of the post. A hole is drilled into the foundation through the slant anchor so that the axis of the hole aligns with the central axis of the post. A bolt is then drilled into the foundation so that a head of the bolt engages the stop plate as a threaded portion of the bolt extends through the through-hole of the stop plate, within the cavity of the post, through the hole in the base plate, and threadably engages the foundation beneath the concrete structure. Therefore, a slant anchor and method for use according to the present disclosure provides an improved securing means for a concrete structure to a foundation where a hole is drilled through the slant anchor into the foundation and a bolt is driven into the drilled hole to engage a stop plate of the slant anchor and threadably engage the foundation beneath the slant anchor.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature; may be achieved with the two components (electrical or mechanical) and any additional intermediate members being integrally formed as a single unitary body with one another or with the two components; and may be permanent in nature or may be removable or releasable in nature, unless otherwise stated.

The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional implementations that also incorporate the recited features. Numbers, percentages, ratios, or other values stated herein are intended to include that value, and also other values that are "about" or "approximately" the stated value, as would be appreciated by one of ordinary skill in the art encompassed by implementations of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

Also for purposes of this disclosure, the terms "upper," "lower," "right," "left," "rear," "front," "vertical," "horizontal," and derivatives thereof shall relate to the orientation shown in FIG. 1. However, it is to be understood that various alternative orientations may be provided, except where expressly specified to the contrary. It is also to be understood that the specific devices and processes illustrated in the attached drawings, and described in this specification are simply exemplary embodiments of the inventive concepts defined in the appended claims. Hence, specific dimensions and other physical characteristics relating to the embodiments disclosed herein are not to be considered as limiting, unless the claims expressly state otherwise.

Changes and modifications in the specifically described embodiments may be carried out without departing from the principles of the present invention, which is intended to be limited only by the scope of the appended claims as interpreted according to the principles of patent law. The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A foundation connection device for a concrete structure, the foundation connection device comprising:

a base plate having an aperture and a lower surface configured to substantially align with a bottom surface of the concrete structure;

a tubular post having a lower end attached to the base plate around the aperture and an upper end configured to be disposed in the concrete structure and interconnect with a side recess in the concrete structure;

an anchoring member having a lower portion coupled to at least one of the base plate and the tubular post and an upper portion that includes engagement features that are configured to form an embedded connection in the concrete structure;

a stop member fixed within an interior the tubular post and comprising a through-hole and a peripheral upper surface surrounding the through-hole; and a bolt having a head configured to engage the peripheral upper surface of the stop member and a shaft configured to extends through the through-hole of the stop member and the aperture of the base plate for engaging into a foundation supporting the concrete structure, wherein the upper end of the tubular post comprises a flange and defines an upper opening surrounded by the flange, the flange having a planar outer surface configured to be exposed at a vertical surface of the concrete structure when connecting the concrete structure to the foundation.

2. The foundation connection device of claim 1, wherein the planar outer surface is perpendicular to an upper surface of the base plate.

3. The foundation connection device of claim 1, wherein a central axis of the tubular post is oriented at a non-right angle relative to the base plate.

4. The foundation connection device of claim 1, wherein the anchoring member comprises an anchor rod disposed at an exterior surface of the tubular post, and wherein the engagement features comprise a ribbed surface.

5. The foundation connection device of claim 4, wherein the anchor rod comprises a lower section tangential and attached to the exterior surface of the tubular post and an upper section remote from the tubular post and angled relative to the lower section so as to be perpendicular to the base plate.

6. The foundation connection device of claim 1, wherein the anchoring member comprises at least one of an anchor rod or a strap.

7. The foundation connection device of claim 1, wherein a central axis of the tubular post is oriented at an angle between 10 and 50 degrees relative to the base plate.

8. The foundation connection device of claim 1, wherein the anchoring member comprises two anchor rods attached to an outer surface of the tubular post.

9. The foundation connection device of claim 8, wherein the anchor rods are positioned at outboard positions on the outer surface of the tubular post so that the anchor rods are substantially aligned with outer edges of the base plate.

10. A foundation connection device configured to be embedded within a concrete structure at a bottom surface of the concrete structure for securing the concrete structure to a foundation when a bolt engages the foundation connection device and is driven into the foundation, the foundation connection device comprising:

a base plate comprising an upper surface, a lower surface opposite the upper surface, and an aperture through the upper and lower surfaces, the lower surface configured to substantially align with the bottom surface of the concrete structure;

a tubular post comprising a lower end connected to the base plate and defining an opening at the lower end that surrounds the aperture of the base plate, wherein a central axis of the tubular post is oriented at a non-right angle relative to the base plate;

an anchoring member comprising a lower portion coupled to at least one of the base plate and the tubular post and an upper portion that has engagement features configured to form an embedded connection in the concrete structure; and a stop member fixed within an interior the tubular post and comprising a through-hole and a peripheral upper surface surrounding the through-hole, wherein when the bolt engages the foundation connection device and is driven into the foundation, a shaft of the bolt extends through the through-hole of the stop member and the aperture of the base plate into the foundation and a head of the bolt engages the peripheral upper surface of the stop member, wherein an upper end of the tubular post comprises a flange and defines an upper opening surrounded by the flange, the flange having a planar outer surface configured to be exposed at a vertical surface of the concrete structure when connecting the concrete structure to the foundation.

11. The foundation connection device of claim 10, wherein the planar outer surface is perpendicular to the upper surface of the base plate.

12. The foundation connection device of claim 10, wherein the anchoring member comprises an anchor rod disposed at an exterior surface of the tubular post.

13. The foundation connection device of claim 12, wherein the anchor rod comprises a lower section tangential and attached to the exterior surface of the tubular post and an upper section remote from the tubular post and angled relative to the lower section so as to be perpendicular to the base plate.

14. The foundation connection device of claim 13, wherein a linear extent of the upper section of the anchor rod is aligned with the aperture in the base plate.

15. The foundation connection device of claim 10, wherein the anchoring member comprises at least one of an anchor rod or a strap.

16. The foundation connection device of claim 10, wherein the central axis of the tubular post is oriented at an angle between 10 and 50 degrees relative to the base plate.

17. A method for securing a concrete structure to a foundation with a foundation connection device disposed within the concrete structure, the method comprising:

providing a foundation connection device comprising a base plate having an aperture through the base plate and a tubular post defining a cavity, the tubular post disposed at an upper surface of the base plate surrounding the aperture at a first end and extending at a non-right angle relative to the base plate;

positioning and retaining a lower surface of the base plate of the foundation connection device at an interior wall of a concrete form so that the lower surface of the base plate will be aligned with a bottom surface of the concrete structure made using the concrete form;

pouring liquid concrete into the concrete form such that the poured liquid concrete does not enter the cavity of the tubular post;

curing the liquid concrete to form the concrete structure and removing the concrete form from the formed concrete structure;

erecting the formed concrete structure at the foundation such that the lower surface of the base plate and the bottom surface of the concrete structure engage an upper surface of the foundation;

drilling along a central axis of the tubular post into the upper surface of the foundation to form a hole in the foundation;

driving a bolt through a stop member within the cavity of the tubular post and into the hole in the foundation until a bolt head of the bolt engages an upper surface of the stop member so that a shaft of the bolt engages the foundation connection device to the foundation; and covering an exposed flanged opening at a second end of the tubular post with patching grout to provide a smooth outer surface of the concrete structure.

18. The method of claim 17, wherein, before pouring liquid concrete into the concrete form, a foam plug is positioned at the second end of the tubular post to prevent liquid concrete from entering the flanged opening.

* * * * *